US005432958A

United States Patent [19]

Bochmann et al.

[11] Patent Number: 5,432,958

[45] Date of Patent: Jul. 18, 1995

[54] READILY DETACHABLE CYLINDRICAL SECTIONS VALVE

[75] Inventors: Carl E. Bochmann; Cherry A. Bochmann, both of Brecksville; James A. Sigler, Big Prairie, all of Ohio

[73] Assignee: Sealand Technology, Inc., Big Prairie, Ohio

[21] Appl. No.: 280,993

[22] Filed: Jul. 27, 1994

[51] Int. Cl.[6] ..... E03D 1/00

[52] U.S. Cl. ..... 4/321; 4/300

[58] Field of Search ..... 4/300, 321

[56] References Cited

U.S. PATENT DOCUMENTS

| | | | |
|---|---|---|---|
| 658,975 | 10/1900 | Clancy . | |
| 3,504,886 | 4/1970 | Hulslander et al. . | |
| 3,572,383 | 3/1971 | Natalizia . | |
| 3,591,135 | 7/1971 | Miller . | |
| 3,851,339 | 12/1974 | Flinner et al. | 4/321 |
| 4,180,244 | 12/1979 | Rosenitsch . | |
| 4,319,366 | 3/1982 | Baler, Jr. et al. | 4/321 X |
| 4,676,272 | 6/1987 | Jackson . | |
| 4,819,279 | 4/1989 | Sigler et al. . | |
| 5,031,249 | 7/1991 | Sargent | 4/321 |

*Primary Examiner*—John C. Fox
*Attorney, Agent, or Firm*—Nixon & Vanderhye

[57] ABSTRACT

A valve used in a sewage handling system allows outer casing components to be disconnected from each other while both of the fluid transporting or retaining components that are connected to the valve remain sealed from the environment when the valve is in a closed position. Yet, the valve can be operated by simple rotation of a single actuator. For example, the valve connects a conduit connected to a toilet with a sewage holding tank. The valve includes first and second connecting parts of an outer casing which are circular cross section housed cylinders with one end perpendicular to the axis of elongation of the cylinder and the second end forming an oval face disposed at an angle of about 35°-55° to the axis of elongation. First and second inner valve components have the same basic shape as the outer casing parts so that when the first inner element is aligned with a first outer casing part, the valve is completely closed and may be disassembled, whereas when the inner and outer parts are out of phase 180°, the valve is completely open and allows sewage to flow from the conduit to the holding tank.

11 Claims, 3 Drawing Sheets

READILY DETACHABLE CYLINDRICAL SECTIONS VALVE

BACKGROUND AND SUMMARY OF THE INVENTION

In the handling of sewage especially on boats and recreational vehicles, sewage is typically transported from a toilet (e.g., utilizing a vacuum pump) to a sewage holding tank, which is emptied at a suitable location where it can be handled and in an environmentally-responsible manner. Sometimes it is desirable to move the holding tank, disconnect the sewage hose or other conduit coming from the toilet, or repair or replace components of the system. While one way that this could be effected is to provide a plurality of valves connecting the holding tank to a sewage conduit, for example, one then has the expense of two or more valves, and the operation of the two or more valves is required to open or shut down the system.

According to the present invention, a system, and a valve that is ideally suited for the system (although it is useful in other contexts too), are provided which allow ready disconnection of a conduit in a holding tank (or other fluid conducting or retaining components) so that both are sealed from the environment, utilizing a single valve actuator.

According to one aspect of the present invention, a valve is provided comprising: An outer casing including a first connecting part for connection to a first fluid transporting or retaining component, and a second connecting part distinct from but mating with the first connecting part, and for connection to a second fluid transporting or retaining component. First and second inner movable valve elements movable from an open position allowing flow of fluid from a first fluid transporting or retaining component to a second fluid transporting or retaining component, and a closed position in which fluid cannot flow between first and second fluid transporting or retaining components, the inner elements when in the closed position allowing disassembly of the first connecting part from the second connecting part without either of the first and second fluid transporting or retaining components communicating with the surrounding environment at the valve.

First and second stationary seals may act between the outer casing and the movable valve element. The first seal may be disposed adjacent the connection of the conduit to the outer casing, the second seal opposite the first seal from the outer casing and in alignment with the first seal.

The outer casing first and second parts each comprise a circular cross section hollow cylinder having an axis of elongation, the first end substantially perpendicular to the axis of elongation, and the second end forming an oval surface disposed at an angle significantly less than 90° (preferably about 35°-55°) with respect to the axis of elongation. The oval surfaces of the outer casing parts are in face-to-face engagement with each other. The first outer casing part second end is typically open, and the second outer casing part second end is typically closed.

The first and second movable valve elements comprise a circular cross section hollow cylinder having a sidewall and an axis of elongation, the first end substantially perpendicular to the axis of elongation, and a second end forming an oval surface disposed at an angle significantly less than 90° (typically about 35°-55°) with respect to the angle of elongation. The oval surfaces of the first and second movable valve element are in face-to-face engagement with each other. The first movable element has a solid sidewall and open second end, and the second element has an open second end and an opening in the sidewall for cooperation with tile first fluid conducting or retaining component, while the open first end communicates with the second fluid conducting or retaining component when the movable valve elements are in the open position.

The first and second movable valve elements are mounted in the outer casing for rotation about an axis of rotation aligned with the axis of elongation of the cylinders forming the valve elements. An actuator is typically provided adjacent the first end of the first movable valve element, and the first end of the first outer casing has an opening therein through which the actuator extends (into contact with the first movable valve element). A vent may be provided in an overlapping area of the valve elements.

According to another aspect of the present invention a valve per se is provided. The valve comprises the following elements: an outer casing including a first connecting part for connection to a first fluid transporting or retaining component, and a second connecting part distinct from but mating with the first connecting part, and for connection to a second fluid transporting or retaining component. First and second inner movable valve elements movable from an open position allowing flow of fluid from a first fluid transporting or retaining component to a second fluid transporting or retaining component, and a closed position in which fluid cannot flow between first and second fluid transporting or retaining components. The outer casing first and second parts each comprise a circular cross section hollow cylinder having an axis of elongation, a first end substantially perpendicular to the axis of elongation, and a second end forming an oval surface disposed at an angle of significantly less than ninety degrees with respect to the axis of elongation, the oval surfaces being in face-to-face engagement with each other. The first outer casing part second end is open and the second outer casing part second end is closed. The first and second movable valve elements each comprise a circular cross section hollow cylinder having a sidewall and an axis of elongation, a first end substantially perpendicular to the axis of elongation and a second end forming an oval surface disposed at an angle significantly less than 90 degrees with respect to the axis of elongation; the oval surfaces of the first and second movable valve elements in face-to-face engagement with each other; the first movable valve element having a solid sidewall and open second end, and the second element having an open second end and an opening in the sidewall for cooperation with the first fluid conducting or retaining component while the open first end communicates with the second fluid conducting or retaining component when the movable valve elements are in the open position.

The invention also relates to a sewage handling system comprising at least one toilet, a sewage holding tank having a sewage receiving opening therein, and a conduit operatively connected to the at least one toilet (e.g., through a vacuum pump). The conduit comprises the first fluid transporting or retaining component as described above, and the holding tank the second.

Various indicia may also be provided on the components—for example, on the actuator and on a sealcontaining projection opposite the connection of the conduit to the outer casing—for indicating when the valve is in the closed position, and therefore, that the components can be disassembled. Alternatively, seals may be provided on a movable element instead of associated with the outer casing, if the proper quality of sealing material can be used economically for the intended environment.

It is a primary object of the present invention to provide an improved sewage handling system, and a valve ideally suited for use in such a system, but also suitable for other purposes. This and other objects of the invention will become clear from an inspection of the detailed description of the invention, and from the appended claims.

DETAILED DESCRIPTION OF THE DRAWINGS

Figure 1:
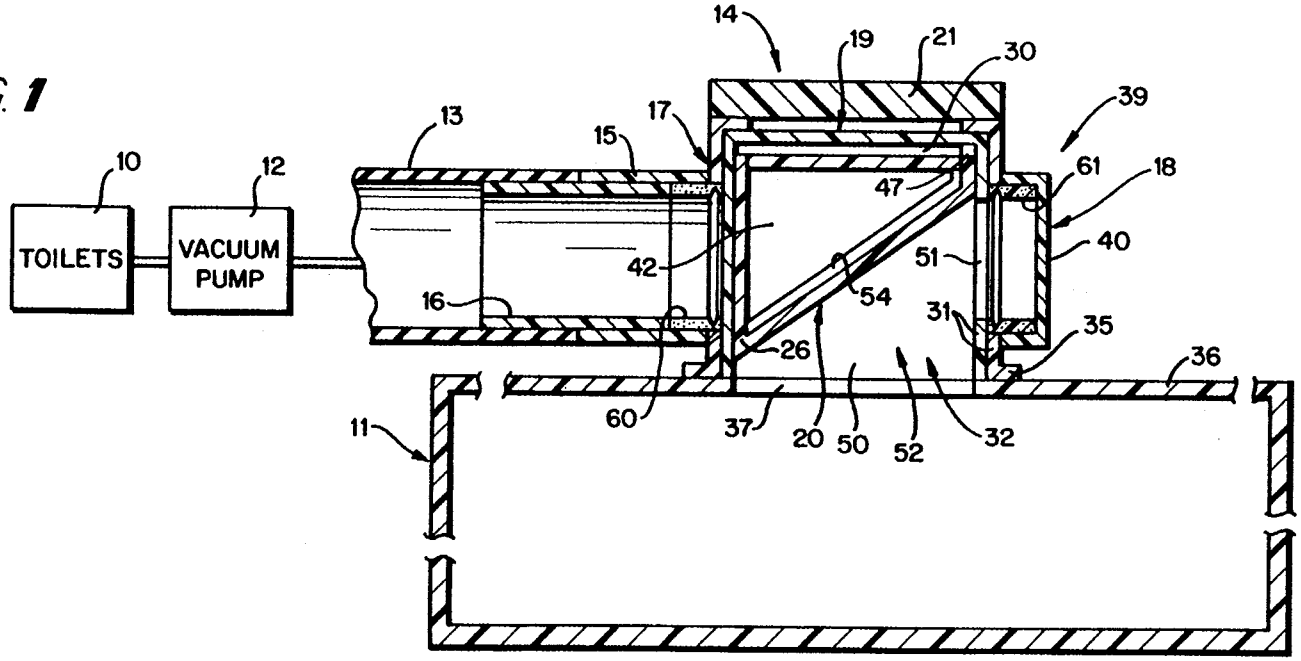
FIG. 1 is a side cross-sectional view, partly schematic, of an exemplary sewage handling system according to the present invention.

An exemplary sewage handling system according to the present invention is illustrated, partly schematically, in FIG. 1. One or more toilets 10 are provided which are operatively connected to a sewage holding tank 11 or the like. The sewage handling system according to the invention can be land based, but the invention is particularly applicable to boat, recreational vehicle, or airplane mounted systems. Such portable systems typically have a vacuum pump 12 or the like associated therewith, and are as generally illustrated in U.S. Pat. No. 4,819,279 (the disclosure of which is hereby incorporated by reference herein).

A conduit, typically in the form of a flexible hose 13, is provided operatively connecting the toilet or toilets 10 to the holding tank 11 through a valve shown generally by reference numeral 14. As seen in FIG. 1, the conduit 13 may slide half-way over an interior tube 16, and the interior tube 16 may fit within a stationary tube 15 which is part of, or operatively connected to, the valve 14 which is typically is of hard plastic, metal, or the like.

Figure 3:
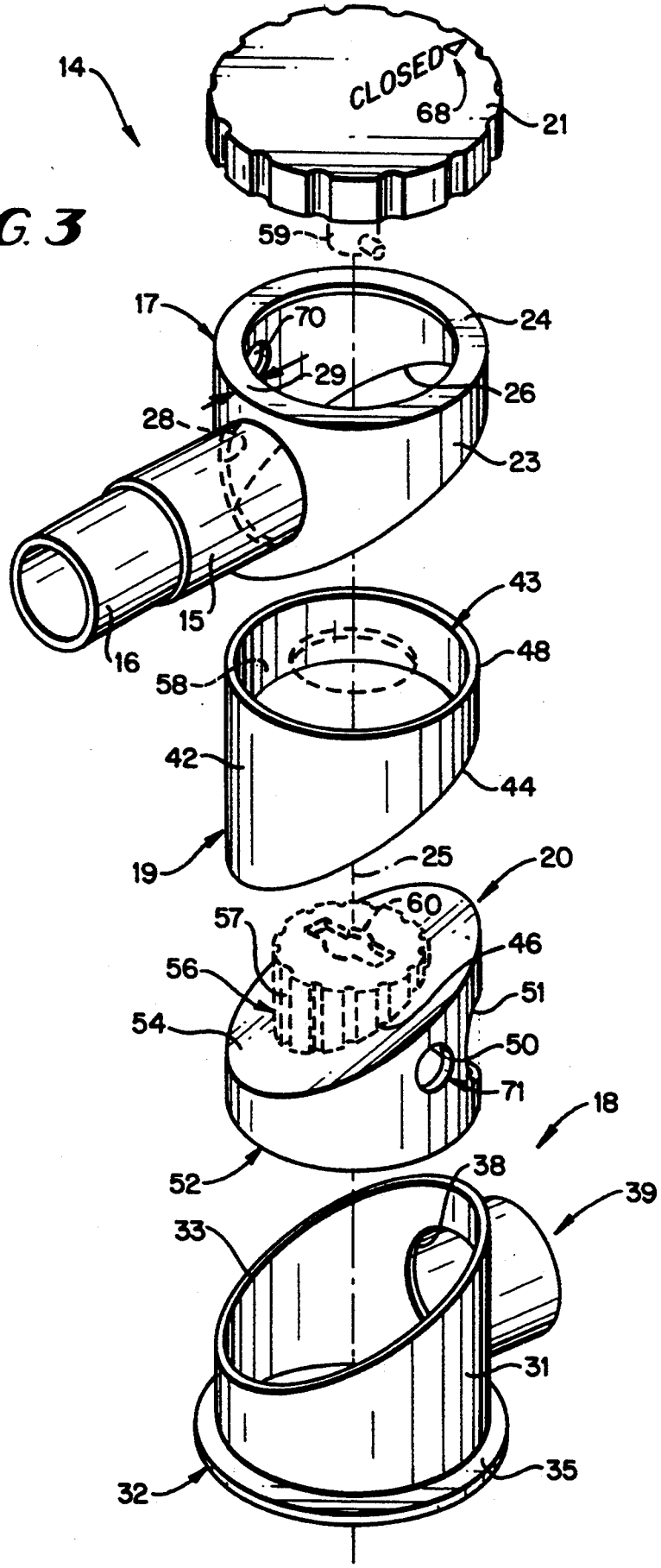
FIG. 3 is an exploded perspective view of the valve of FIGS. 1 and 2.

As seen most clearly in FIGS. 1 and 3, the valve 14 has as main components thereof first and second outer casing parts 17, 18, respectively, and first and second inner movable valve elements 19, 20, respectively. An actuator 21 also is provided for moving the elements 19, 20 with respect to the casing 17, 18.

The first outer casing part 17 includes a generally cylindrical hollow element having a circular cross section, a sidewall 23, a first end 24 substantially perpendicular to the axis of elongation 25 of all of the components 17–20, and a second end opposite the first end forming a generally oval surface 26 which is disposed at a significantly less than 90° angle with respect to the axis 25—in the exemplary embodiment illustrated in the drawings, and preferred, the angle of a plane defining the surface 26 intersecting the axis 25 is about 55° As seen in FIG. 3, there is an opening 28 formed in the sidewall 23 in communication with the tube 15, and the conduit 13 which ultimately abuts or joins the tube 15. As also seen in FIG. 3, the end defining the surface 26 is essentially completely open. Also, the first end 24 is primarily open although an annular border 29 is provided with an axial projection 30 from the actuator 21 extending therethrough.

The second part 18 of the outer casing has a shape very similar to that of the first part 17, including having a circular cross section hollow cylindrical shape with a sidewall 31 a first end 32 which is generally perpendicular to the axis 25, and a second end defining a generally oval surface 33 which makes an angle to the axis 25 complementary to the angle provided by the surface 26, and in the exemplary preferred embodiment illustrated in the drawings is about 35°. Both of the ends 32, 33 of the part 18 are open. The first end 32 also has a flange 35 associated therewith which is connected (e.g., by adhesive, welding, ultrasonic welding, or the like) to the top surface 36 of the sewage holding tank 11, so that the open end 32 surrounds a generally circular opening 37 formed in the top surface 36 of the holding tank 11 (see FIG. 1).

Figure 2:
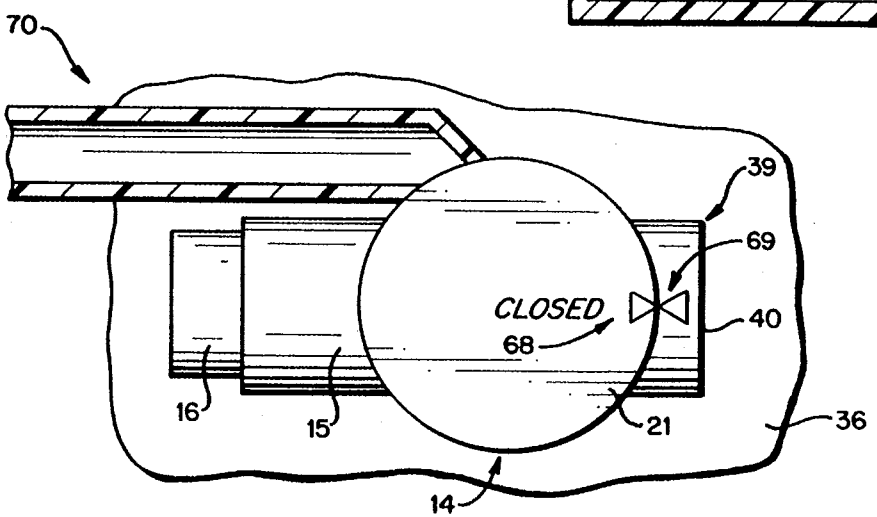
FIG. 2 is a top plan view of components of the system of FIG. 1 on top of the sewage holding tank.

The sidewall 31—in the preferred embodiment illustrated in FIG. 1 through 3—also preferably includes an opening 38 formed therein, opposite the opening 28 in the first part 17 and of substantially the same size, which is connected to a blind seal-mounting housing 39, which comprises a hollow tube having a closed end 40 opposite the sidewall 31.

The removable valve elements 19, 20 have basic configurations almost identical to those of the outer casing components 17, 18, although having a smaller diameter since the inner components 19, 20 are mounted within the outer casing parts 17, 18. The first movable valve element 19, which is preferably made of a hard plastic, but may also be made of metal or other suitable materials, is also a generally hollow cylinder having a basically solid sidewall 42, a first—primarily open (in solid line in FIG. 3)—end 43 generally perpendicular to the axis 25, and a second end defining a generally oval shaped surface 44 disposed at an angle substantially less than 90° with respect to the axis of elongation 25 (e.g. the complement of the angle of 46 illustrated in FIG. 3) typically about 55°, just like the angle of the surface 26 of the outer casing part 17. A movable valve element 19 fits snugly in the outer casing part 17, the annular ledge 29 preventing the element 19 from moving through the generally open end 24.

The second movable valve element 20 is basically the same shape as the outer casing element 18 only with a slightly smaller diameter so that it fits therein. It includes a generally cylindrical hollow body element having a sidewall 50 which includes an opening 51 therein which is dimensioned to cooperate with the openings 28, 38 (and the seals associated therewith, which will be described hereafter). It also includes an open first end 52 which communicates with the opening 37 in the top 36 of the holding tank 11, and a second, closed, end defining an oval shaped planar surface 54, which makes the angle 46 (typically about 35°, and the complement angle defined by the surface 44) to the axis of elongation 25. The sidewall 50 makes a tight fit with the inside surface of the second outer casing element 18, but rotation therebetween is allowed about an axis of rotation aligned with the axis of elongation 25.

As an alternative way of providing the driving action for rotation of the movable valve elements, 19, 20, a closed face exteriorly grooved cylindrical element 56—shown in dotted line in FIG. 3—may extend upwardly from the face 44 concentric and aligned with the axis of elongation 25. An interior portion (not shown) of element 19 may have a surface complementary to grooves 57 on the projection 56 so that rotation of element 19 effects rotation of element 20.

Other mechanisms may also be utilized to provide driving action between the movable elements (i.e. 19, 20, 21). For example, a primarily solid top surface—shown in dotted line at 58 in FIG. 3—is provided, and actuator 21 may be bolted to it. Then keying moving parts 56/57 with an interior portion of element 19 will cause in unison rotation of elements 21, 20, 19. Still further, actuator 21 may have a square, a splined, or cross-pinned round shaft (see dotted line configuration 59 in FIG. 3) which cooperates with a female similarly shared opening (shown in dotted line at 60 in FIG. 3) in the top of rotating part 20. The interengagement of elements 59, 60, and the engagement of an interior portion of element 19 with cylinder 56 and grooves 57, will cause the parts 21, 20, 19 to move in unison.

While sealing action may be provided by utilizing O-rings, or other sealing components, mounted in grooves, or slightly upstanding from, the sidewalls 42, 50 of the elements 19, 20, preferably stationary seals are provided. The stationary seals extend through the openings 28, 38 into engagement with the sidewalls 42, 50 of the elements 19, 20. The first seal element is shown within the tube 15 and abutting the tube 14 in FIG. 1 by reference numeral 60; the second seal element is seen opposite thereof, and indicated by reference numeral 61. Thus the seal 60 extends through the opening 28, while the seal 61 extends through the opening 38 (neither of the seals 60, 61 is seen in FIG. 3, having been removed for clarity of illustration). The seals 60, 61 are made of a suitable sealing material, such as EDPM.

Figure 4:
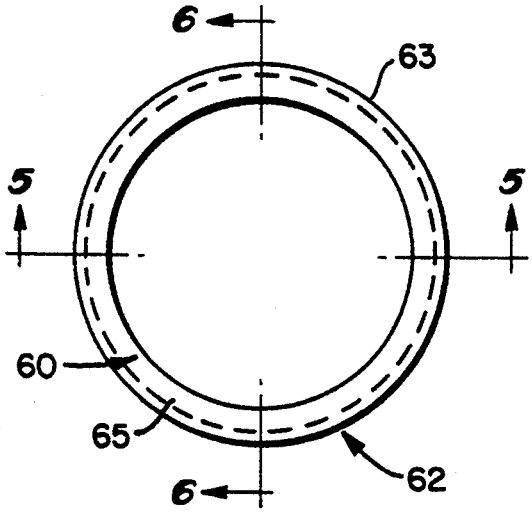
FIG. 4 is an end view of one of the seals associated with the valve of FIG. 1.
Figure 5:
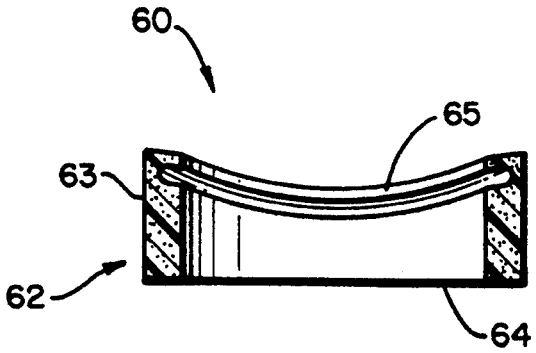
FIGS. 5 and 6 are cross-sectional views taken along lines 5—5 and 6—6 of FIG. 4.
Figure 6:
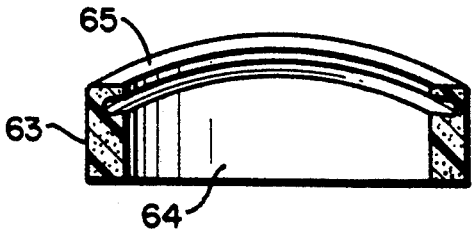

The configuration of the seals is best seen from FIGS. 4 through 6 in which the seal 60 is illustrated, it being understood that the seal 61 is substantially identical. The seal 60 comprises a body 62 having a generally hollow cylindrical shape, with a sidewall 63, one end 64 that is generally perpendicular to the axis of elongation of the cylindrical body 62, and a second, contoured surface 65, which is adapted to engage the cylindrical sidewalls 42, 50 and to preclude movement of the fluid being valved between the seal 60 and the sidewalls 42, 50.

Optionally, indicia is provided for indicating when there is alignment of the opening 51 with the opening 38 (and thus the valve is closed). This can be accomplished, where the actuator 21 and at least one of the movable valve elements 19, 20 are keyed to each other, by providing indicia 68 on the top surface of the actuator 21 (see FIGS. 2 and 3) and providing like indicia at another location on the stationary valve casing. Preferably this other indicia is illustrated by reference 69 in FIG. 2, mounted on the top exterior surface of the blind seal-seat 39.

Under some circumstances it is desirable to also provide a vent for the valve 14. This may be accomplished, for example, by providing the vent passage 70 illustrated in FIG. 2 which cooperates with a vent hole 71 (see FIG. 3) provided in an overlapping portion of the sidewall 50 of element 20. When the valve is open (so that fluid can pass through conduit 13 and openings 28 and 51) the vent passage 70 would be aligned with the vent hole 71 so that gas could be expelled from the head space of tank 11. When the valve is closed the vent passage 70 is covered by the solid wall 31 of housing part 18. A seal system (e.g. similar to that in FIGS. 4–6) may be provided, or one may simply rely on a close fit between the moving parts and the housing parts to minimize gas escape.

As yet another alternative, instead of the blind stationary seal-seat 39, another tubular connection for a hose or like conduit (comparable to the connection 15, 16) may be provided.

Operation of the valve element 14 is simple. When it is desired to open the valve to allow sewage to flow through the conduit 13, opening 37 in the top 36 of the tank 11, and into the tank 11, the actuator 21 is rotated until the opening 51 in the sidewall 50 of the second movable valve element 20 aligns with the opening 28. In this position, the first element 19, which rotates with the second element 20, has a sidewall 42 which seals the opening 38, the seal 60 preventing leakage around the opening 28, and the seal 61 preventing leakage around the opening 38. When it is then desired to close the valve, the actuator 21 is rotated until the indicia 68, 69 are aligned (see FIG. 2). In this position, the opening 51 is in alignment with the opening 38 while the sidewall 42 blocks the opening 28. Again the seals 60, 61 cooperate with the sidewall 42 and the sidewall 50 surrounding the opening 51, to prevent leakage.

When the valve 14 is in the closed position, the conduit 13 may be detached from the holding tank 11 without exposing the interior of either to the environment (and thus preventing the release of unpleasant and environmentally harmful gases). The opening 37 communicates only with the blind seal-seat 39, the surface 54 precluding passage of fluid from the tank 11 into the atmosphere or into the conduit 13, while the conduit 13 is closed by the sidewall 42 with the first movable valve element 19. That is, the valve 14 may be disassembled so that the actuator 21, first outer casing element 17, and first movable valve element 19 are completely detached from the elements 18, 20. The components may then be re,attached as desired.

While normally just the inherent surface engagement between the elements 17, 19 on the one hand and 18, 20 on the other, will hold the elements together during movement of the components when the valve is closed, a mechanism for more positively holding them together may be utilized if desired. For example alignment openings could be formed in the elements 17, 19 for receipt of a pin, which could extend therethrough when the valve 14 was in the closed position to hold them together during separation. Alternatively a cam latch can clamp the housings 17, 18 together; or a molded or spring and ball detent may be provided in a spline between parts 19, 20 to hold them together. Any other suitable mechanism may also be provided as long as it performs this function.

If desired conventional stop means may also be provided to limit the rotation of element 20 in element 18, and element 19 in element 17, to about 180°.

While the valve 14 according to the invention has been described in association with its primary use—in a sewage system—r should be understood that it may be utilized in a wide variety of other circumstances also. For example it could be used in any circumstance in which the fluids being valved are undesirable to release to the environment under any circumstances, such as hydrocarbon vapors, either by themselves or associated with flowing hydrocarbon liquids, or other potentially toxic liquids having potentially toxic gases associated therewith.

While the invention has been herein shown and described in what is presently conceived to be the most practical and preferred embodiment it will be apparent to those of ordinary skill in the art that many modifications may be made thereof within the scope of the invention, which score is to be accorded the broadest interpretation of the appended claims so as to encompass all equivalent structures and devices.

What is claimed is:

1. A sewage handling system comprising:

at least one toilet;

a sewage holding tank having a sewage receiving opening therein;

a conduit operatively connected to said at least one toilet; and a valve connecting said conduit to said opening, said valve comprising: an outer casing including a first connecting part connected to said conduit, and a second connecting part distinct from but mating with said first connecting part, and connected to said opening; and inner movable valve elements movable from an open position allowing flow of sewage from said conduit to said holding tank opening, and a closed position in which sewage cannot flow between said conduit and holding tank, said inner elements, when in said closed position, allowing disassembly of said first connecting part from said second connecting part without either said conduit or said sewage tank opening communicating with the surrounding environment.

2. A system as recited in claim 1 further comprising first and second stationary seals acting between said outer casing and said movable valve elements.

3. A system as recited in claim 2 wherein said first seal is disposed adjacent the connection of said conduit to said outer casing.

4. A system as recited in claim 3 wherein said second seal is mounted opposite said first seal from said outer casing and in alignment with said first seal.

5. A system as recited in claim 4 wherein said outer casing first and second parts each comprise a circular cross section hollow cylinder having an axis of elongation, a first and substantially perpendicular to said axis of elongation, and a second end forming an oval surface disposed at an angle of significantly less than ninety degrees with respect to said axis of elongation, said oval surfaces being in face-to-face engagement with each other.

6. A system as recited in claim 5 wherein said first outer casing part second end is open and said second outer casing part second end is closed.

7. A system as recited in claim 6 wherein the angles at which said outer casing part second ends are disposed are complementary, and are between about 35°–55°.

8. A system as recited in claim 7 wherein said movable valve elements comprise first and second movable valve elements each comprising a circular cross section hollow cylinder having a sidewall and an axis of elongation, a first end substantially perpendicular to said axis of elongation and a second end forming an oval surface disposed at an angle of about 35°–55° with respect to said axis of elongation; said oval surfaces of said first and second movable valve elements in face-to-face engagement with each other; said first movable valve element having a solid sidewall and open second end, and said second element having an open second end and an opening in said sidewall for cooperation with said conduit while said open first end communicates with said holding tank opening when said movable valve elements are in said open position.

9. A system as recited in claim 8 wherein said first and second movable valve elements are mounted in said outer casing for rotation about an axis of rotation aligned with said axis of elongation thereof; and further comprising an actuator adjacent said first end of said first movable valve element.

10. A system as recited in claim 9 wherein said second seal seals around the periphery of said second movable valve element sidewall opening when said movable valve elements are in said closed position, and wherein said first seal seals around the periphery of said second movable valve element sidewall opening when said movable valve elements are in said open position.

11. A system as recited in claim 10 further comprising aligning indicia located on said actuator and a stationary element for indicating when said valve is closed.

* * * * *